US007237301B2

(12) United States Patent
Hodgkinson

(10) Patent No.: US 7,237,301 B2
(45) Date of Patent: Jul. 3, 2007

(54) VACUUM HOSE HOLDER AND METHOD OF USE

(76) Inventor: Hugh Richard Hodgkinson, 240 Arbour Ridge Way, N.W., Calgary, Alberta (CA) T3G 3V8

( * ) Notice: Subject to any disclaimer, the term of this patent is extended or adjusted under 35 U.S.C. 154(b) by 675 days.

(21) Appl. No.: 10/728,878

(22) Filed: Dec. 8, 2003

(65) Prior Publication Data

US 2005/0120509 A1 Jun. 9, 2005

(51) Int. Cl.
*A47L 9/24* (2006.01)
*A47L 9/26* (2006.01)

(52) U.S. Cl. ..... 15/323

(58) Field of Classification Search ..... 15/323, 15/246.2, DIG. 10; 242/398, 400, 400.1, 242/402, 404, 404.2, 588, 613, 613.3
See application file for complete search history.

(56) References Cited

U.S. PATENT DOCUMENTS

| | | | | |
|---|---|---|---|---|
| 1,456,935 | A * | 5/1923 | Richardson | 242/400.1 |
| 2,450,172 | A * | 9/1948 | Stoner | 15/323 |
| 2,772,056 | A * | 11/1956 | Geisinger et al. | 242/405.1 |
| 4,506,853 | A * | 3/1985 | Cathey | 248/79 |
| 5,137,156 | A * | 8/1992 | Riczinger et al. | 211/13.1 |
| 5,331,714 | A | 7/1994 | Essex et al. | |
| D383,882 | S | 9/1997 | Medema | |
| 6,260,233 | B1 * | 7/2001 | Wareham et al. | 15/323 |

* cited by examiner

*Primary Examiner*—Terrence R. Till
(74) *Attorney, Agent, or Firm*—Ryan W. Dupuis; Adrian D. Battison; Michael R. Williams

(57) ABSTRACT

A hose holder includes a frame comprising first and second opposed cradles for supporting a vacuum hose wrapped thereabout. The frame is suitably sized for supporting long hoses, for example in the order of 35 feet or more, of the type typically associated with a central vacuuming system. The frame includes first and second clamp members for securement at spaced positions along the rigid pipe typically attached to the vacuum head in the central vacuuming system.

16 Claims, 3 Drawing Sheets

VACUUM HOSE HOLDER AND METHOD OF USE

FIELD OF THE INVENTION

The present invention relates to a method and holder for supporting a vacuum hose, for example a vacuum hose of the type used in a central vacuuming system and the like.

BACKGROUND

In a central vacuuming system, tubing is typically installed within a building structure, connected between wall outlets dispersed throughout the building and a central fixed vacuum collector. A vacuum head is provided which is supported on a rigid section of pipe in communication therewith which acts as an upright handle for pushing the vacuum head along the floor. An elongate flexible hose is provided for connection between the rigid section of pipe of the vacuum head and one of the wall outlets of the tubing.

The elongate flexible hose, in one example, can be 35 feet in length or other common lengths which may be longer, resulting in a hose which often tangles and is awkward for carrying and storage. Various reels and wall mounted units are known, but none are suitably portable for being carried with the vacuum head in a central vacuuming system.

U.S. Pat. No. 5,331,714 to Essex et al and U.S. design Pat. No. 383,882 to Medema disclose examples of carriers for a vacuum hose. In each instance, brackets are disclosed for coupling to the body of an upright vacuum and accordingly are only intended to support a small coil of hose supported thereon. The hose cannot readily be separated from the vacuum for storage nor are the brackets adaptable to the rigid section of pipe of a typical central vacuuming system.

SUMMARY

According to one aspect of the present invention there is provided a hose holder for a vacuum system including a vacuum head supported on an elongate rigid pipe for connection, using an elongate vacuum hose, to a central vacuum tubing system installed in a building, the hose holder comprising:

a frame for supporting the vacuum hose wrapped thereabout; and clamp means for supporting the frame on the rigid pipe.

According to a second aspect of the present invention there is provided a hose holder for a vacuum system including a vacuum head supported on an elongate rigid pipe for connection, using an elongate vacuum hose, to a central vacuum tubing system installed in a building, the hose holder comprising:

first and second cradles for supporting the vacuum hose wrapped thereabout; and first and second clamp members for supporting the respective cradles on the rigid pipe.

According to a further aspect of the present invention there is provided a method of storing an elongate vacuum hose in a vacuum system including a vacuum head supported on an elongate rigid pipe for connection, using the vacuum hose, to a central vacuum tubing system installed in a building, the method comprising:

providing a frame for supporting the vacuum hose thereon;

wrapping the hose about the frame; and supporting the frame on the rigid pipe.

The use of clamps for connection at spaced positions along a rigid pipe as in a central vacuuming system, readily permits the flexible hose of such a vacuuming system to be supported for movement with the vacuum head. The clips can readily be separated from the pipe for separately storing the hose.

The clamp means are preferably releasable for selective separation and reattachment on the rigid pipe. The clamp means may comprise at least one spring clip including a pair of opposed jaws which are biased towards one another to permit release and reattachment thereof.

The frame may span first and second cradles which are at spaced positions from one another at opposing ends of the frame. In this instance, the frame preferably comprises a pair of elongate rails supported spaced apart from one another by crossbars spanning therebetween, each cradle being defined by a crossbar and a pair of end portions of the rail projecting beyond the respective crossbar.

There may be provided a hose clamp suitably arranged for securement of a free end of the vacuum hose therein and which is supported on the frame.

The holder may be provided in combination with a rigid pipe of a vacuum upon which the clamp means are supported.

Preferably, the first and second cradles and the first and second clamp members are all integrally moulded with one another.

The method may include wrapping the hose about the frame in a coil such that a pipe connecting end of the hose is supported at an inner side of the coil and a wall connecting end of the hose is supported on an outer side of the coil.

A wall connecting end of the hose is preferably supported in the hose clamp on the frame.

A pipe connecting end of the hose may be secured in the clamp means when the frame is removed from the rigid pipe for storage.

The frame may be suitably sized to support a vacuum hose greater than 25 feet in length fully within the area defined by each cradle, and preferably would support longer hoses in the order of 35 feet or more.

BRIEF DESCRIPTION OF THE DRAWINGS

In the accompanying drawings, which illustrate an exemplary embodiment of the present invention.

DETAILED DESCRIPTION

Figure 1:
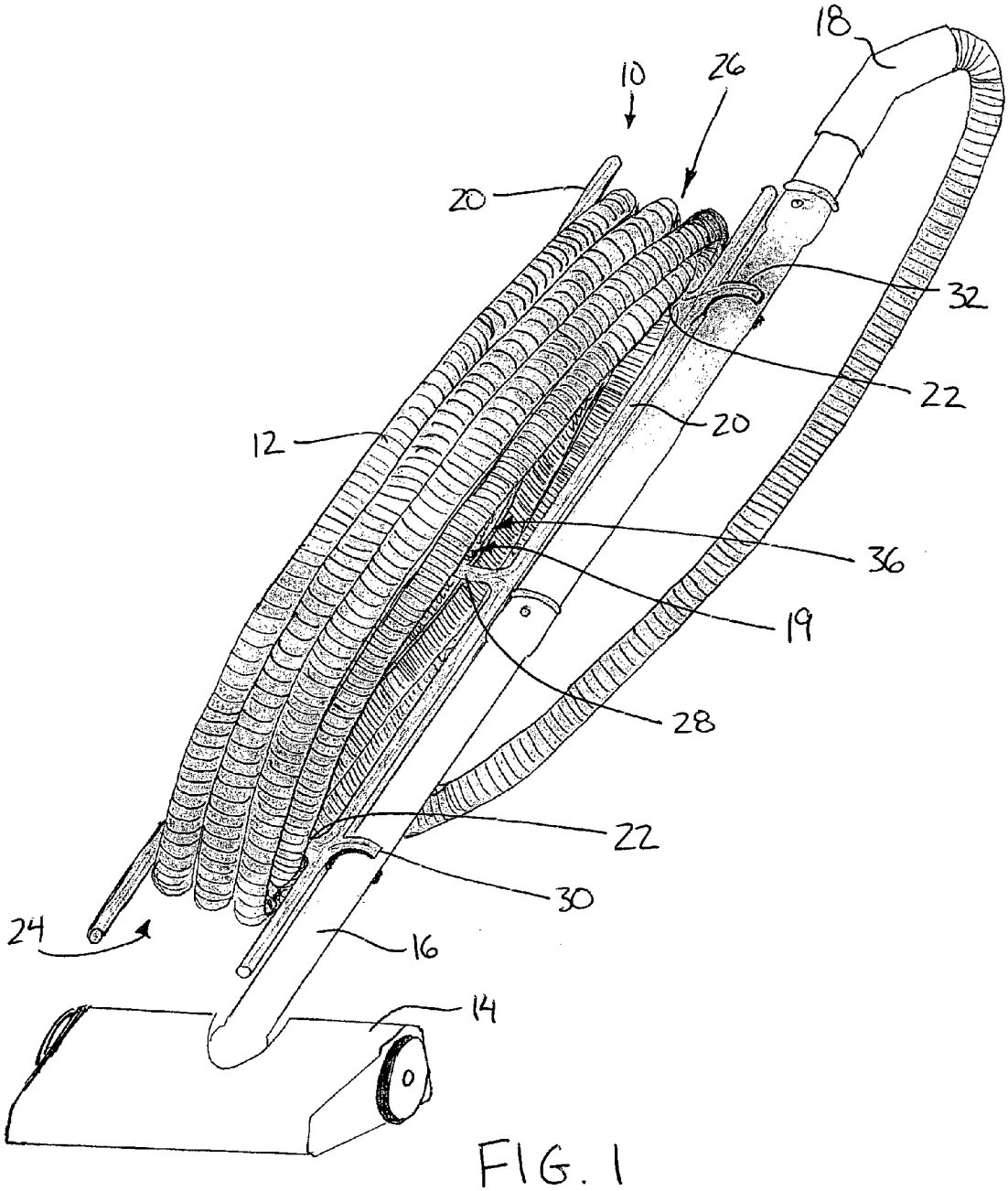
FIG. 1 is a perspective view of the hose holder supported on the rigid pipe of the vacuum head with the vacuum hose wrapped thereabout.
Figure 2:
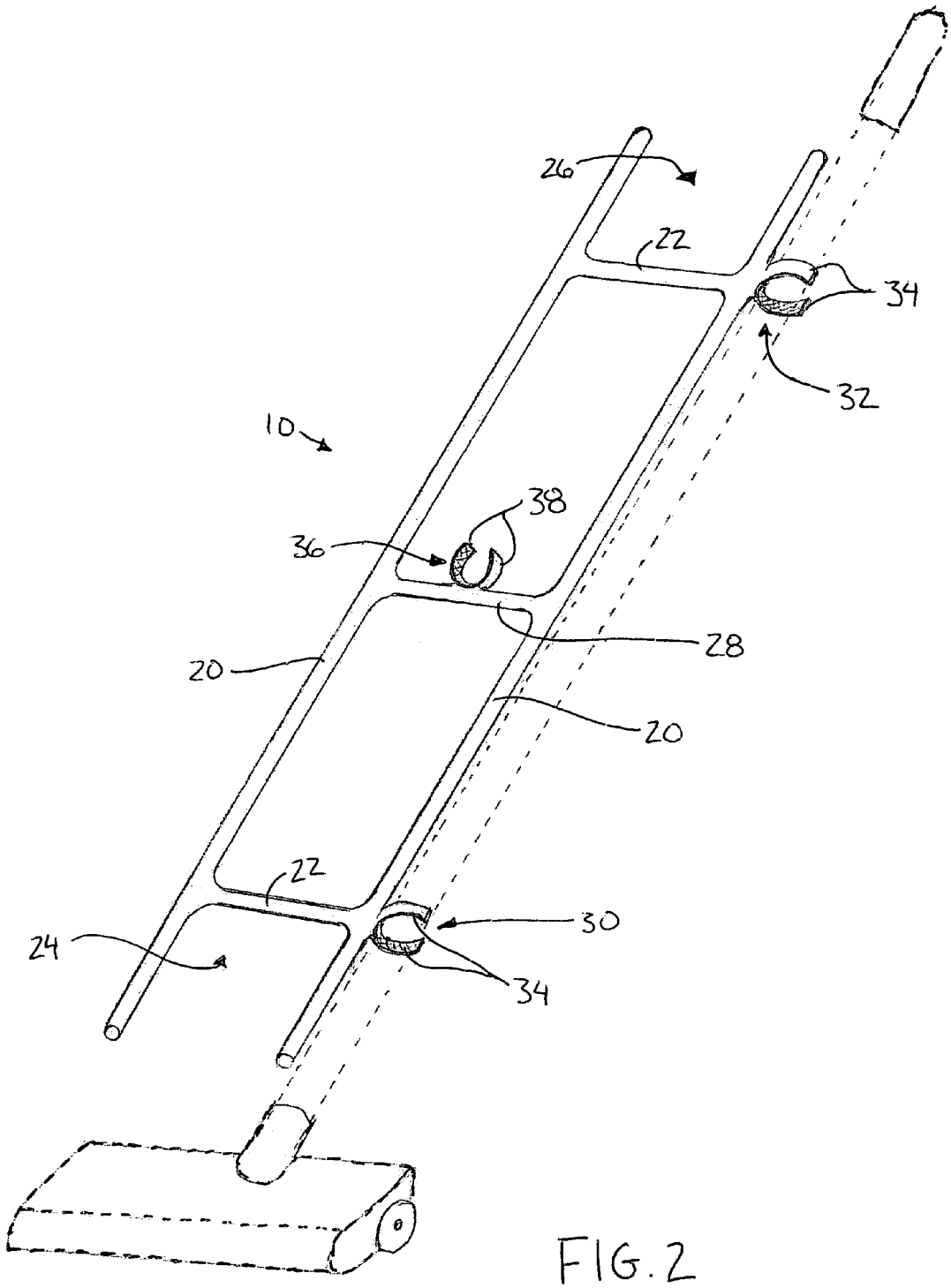
FIG. 2 is a perspective view of the hose holder with the vacuum hose removed therefrom.
Figure 3:
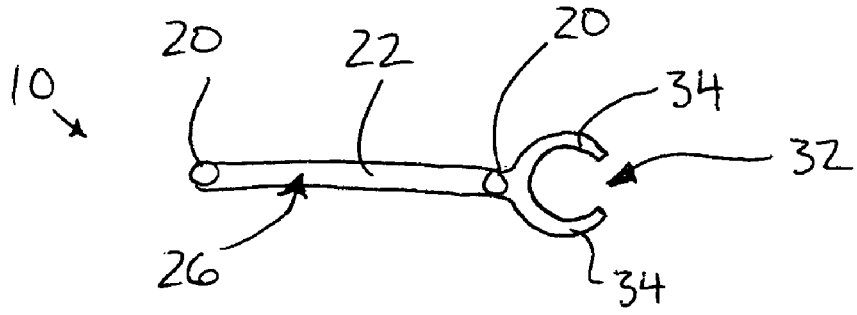
FIG. 3 is a top plan view of the hose holder.
Figure 4:
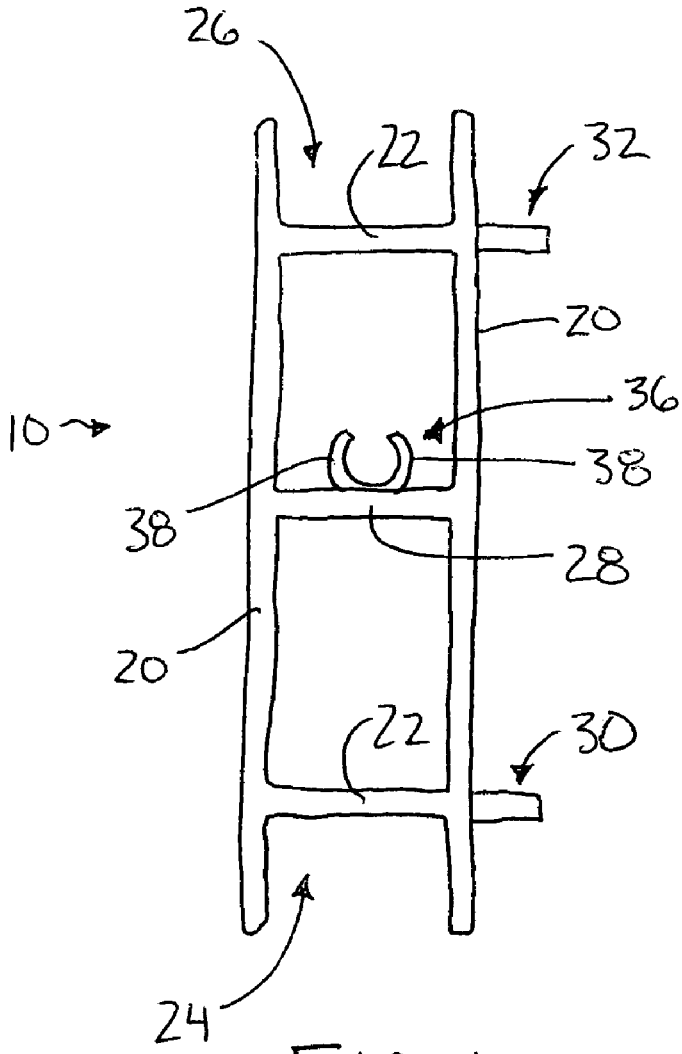
FIG. 4 is a front elevational view of the hose holder.

Referring to the accompanying drawings, there is illustrated a vacuum hose holder generally indicated by reference numeral 10. The vacuum hose holder 10 is particularly suited for carrying the vacuum hose 12 of a typical central vacuuming system.

The central vacuuming system includes tubing installed in a building for communication between a plurality of wall outlets and a central vacuum collector. A push type vacuum head 14 includes a motor for rotating bristles therein and an elongate rigid pipe 16 forming a handle for pushing the vacuum head 14. The rigid pipe 16 communicates between the vacuum head and a pipe connecting end 18 of the hose 12. The hose comprises an elongate flexible tubing extending in a longitudinal direction between the pipe connecting end and a wall connecting end 19 for being received in one of the wall outlets of the central vacuuming system.

The hose holder 10 generally includes a frame comprising two rails 20 which are supported parallel and spaced apart from one another. A pair of cross bars 22 extend between the rails adjacent to but spaced inwardly from the ends of the rails. The crossbars 22 are oriented perpendicularly to the rails and are spaced inwardly sufficiently from the ends of the rails to define first and second cradles 24 and 26 for supporting the hose thereon. Each cradle is generally U-shaped defined by end portions of the respective rails projecting beyond the crossbar and the respective one of the cross bars 22 spanning therebetween such that open ends of the U-shaped cradles extend outwardly in a longitudinal direction of the frame opposite from one another. A central cross bar 28 spans between the rails, perpendicularly thereto at a central location along the rails. The cross bars and rails lie in a generally common plane.

First and second clamp members 30 and 32 are supported at spaced positions along one of the rails 20. Each clamp member comprises a spring clip formed of resilient material extending partway about a circular periphery in a relaxed position. The material forming the clamp members is such that it is biased towards the relaxed position when the jaws 34 of each clamp member are pulled apart from one another. The pair of jaws 34 forming each clamp member confront one another and each extend through an arc of approximately 120 degrees.

The jaws 34 of the clamp members can be flexed apart from one another to receive the circular cross section of the rigid pipe through the gap between the jaws to be subsequently retained within the clamp members when the jaws return to the relaxed position. The resilient material forming the clamp members ensures that the clamp members remain releasable for selective separation and re-attachment as desired.

The first and second clamp members 30 and 32 are aligned with respective ones of the first and second cradles 24 and 26 which they support on the rigid pipe. The jaws 34 of each clamp member are curved about a respective axis which lies parallel to the rails 22 and which is concentric with the jaws 34 of the other clamp member so that both clamp members can be clamped about a common round pipe extending therebetween.

A hose clip 36 is supported on the centre cross bar 28 of the frame. The hose clip 36 comprises a spring clip having a pair of confronting jaws 38 identical in configuration to the jaws 34 of the clamp members. In the relaxed position, the jaws extend partway about a circular periphery of the hose clip while remaining flexible to receive the wall connecting end 19 of the pipe therein which is subsequently retained therein by gripping action of the jaws being biased inwardly towards the relaxed position similarly to the clamp members 30 and 32 described above. The jaws 38 of the hose clip are curved about an axis lying perpendicular to the plane of the frame.

The rails and crossbars of the frame, as well as the clamp members 30 and 32 and the hose clip 36 are all integrally moulded with one another of a suitable plastic material which provides sufficient strength and stiffness for supporting typical central vacuuming hoses thereon while being sufficiently resilient to permit the jaws of the clamp members to be sufficiently separated for receiving the rigid pipe therein.

In use, the pipe connecting end 18 of the hose is connected to the free end of the rigid pipe 16 of the vacuum head. The frame of the holder 10 is then attached to the rigid pipe by means of the clamp members 30 and 32 at spaced positions along the pipe. The hose is then wrapped in a coil about the frame between the opposed first and second cradles starting with the pipe connecting end 18 on an inner side of the coil and terminating with the wall connecting end 19 on an outer side of the coil. The wall connecting end can then be secured in the hose clip 36.

Releasing the hose from the rigid pipe and the clamp members 30 and 32 from the rigid pipe permits the hose holder with the vacuum hose coiled thereon to be released and stored separately as desired. When it is desired to vacuum, the clamp members 30 and 32 and the pipe connecting end of the hose are secured to the rigid pipe, while the wall connecting end 19 is released from the hose clip 36. A desired length of hose is unwrapped from the frame and connected to the appropriate wall outlet. The frame is suitably sized for supporting typical 35 foot length hoses wrapped thereon while being fully contained within the area defined by the respective cradles between the crossbar 22 and the respective end portions of the rails.

While one embodiment of the present invention has been described in the foregoing, it is to be understood that other embodiments are possible within the scope of the invention. The invention is to be considered limited solely by the scope of the appended claims.

The invention claimed is:

1. A hose holder for a vacuum system including a vacuum head supported on an elongate rigid pipe for connection, using an elongate vacuum hose, to a central vacuum tubing system installed in a building, the hose holder comprising:

a frame comprising:

a pair of elongate rails supported spaced apart from one another by crossbars spanning therebetween; and first and second cradles on the frame at spaced positions from one another at opposing ends of the frame, each cradle being defined by a crossbar and a pair of end portions of the rails projecting beyond the respective crossbar so as to be arranged for supporting the vacuum hose wrapped thereabout; and clamp members arranged for supporting the frame on the rigid pipe.

2. The holder according to claim 1 wherein the clamp members are releasable so as to be arranged for selective separation and reattachment on the rigid pipe.

3. The holder according the claim 2 wherein the clamp members comprise at least one spring clip including a pair of opposed jaws which are biased towards one another.

4. The holder according to claim 1 wherein there is provided a hose clamp suitably arranged for securement of a free end of the vacuum hose therein.

5. The holder according to claim 4 wherein the hose clamp is supported on the frame.

6. The holder according to claim 1 wherein the frame and the clamp members are integrally moulded together.

7. The holder according to claim 1 in combination with the rigid pipe of the vacuum system upon which the clamp members are secured.

8. A hose holder for a vacuum system including a vacuum head supported or an elongate rigid pipe for connection, using an elongate vacuum hose, to a central vacuum tubing system installed in a building, the hose bolder comprising:

first and second cradles arranged for supporting the vacuum hose wrapped thereabout; and first and second clamp members arranged for supporting the respective cradles on the rigid pipe;

wherein the first and second cradles and the first and second clamp members are all integrally moulded with one another.

9. The holder according to claim 8 wherein there is provided a frame spanning between the first and second cradles.

10. The holder according to claim 8 wherein there is provided a frame comprising a pair of elongate rails supported spaced apart from one another by crossbars spanning therebetween, each cradle being defined by a respective one of the crossbars and end portions of the rails projecting beyond the respective crossbar.

11. The holder according to claim 8 wherein there is provided a hose clamp arranged for supporting a free end of the hose thereon, the hose clamp being supported on a frame spanning between the first and second cradles.

12. The holder according to claim 8 wherein the first and second clamp members are releasable so as to be arranged for selective separation and reattachment on the rigid pipe.

13. A method of storing an elongate vacuum hose in a vacuum system including a vacuum head supported on an elongate rigid pipe for connection, using the vacuum hose, to a central vacuum tubing system installed in a building, the method comprising:

providing a frame arranged for supporting the vacuum hose thereon;

wrapping the hose about the frame in a coil such that a pipe connecting end of the hose is supported at an inner side of the coil and a wall connecting end of the hose is supported on an outer side of the coil; and supporting the frame on the rigid pipe.

14. The method according to claim 13 including securing a free end of the hose on a hose clamp supported on the frame.

15. The method according to claim 13 including providing clamp members to support the frame on the rigid pipe and securing a free end of the hose in the clamp members when the frame is removed from the rigid pipe for storage.

16. The method according to claim 13 wherein the frame is suitably sized to support a vacuum hose greater than 25 feet in length fully within the area defined by each cradle.

* * * * *